US008853583B2

(12) United States Patent
Cassani

(10) Patent No.: US 8,853,583 B2
(45) Date of Patent: Oct. 7, 2014

(54) METHOD AND A DEVICE FOR SEPARATING PARTICLES OF A DETERMINED SYNTHETIC MATERIAL FROM PARTICLES OF DIFFERENT SYNTHETIC MATERIALS

(76) Inventor: Stefano Cassani, Imola (IT)

( * ) Notice: Subject to any disclaimer, the term of this patent is extended or adjusted under 35 U.S.C. 154(b) by 0 days.

(21) Appl. No.: 13/700,568

(22) PCT Filed: May 13, 2011

(86) PCT No.: PCT/IB2011/001055

§ 371 (c)(1),
(2), (4) Date: Nov. 28, 2012

(87) PCT Pub. No.: WO2011/151690

PCT Pub. Date: Dec. 8, 2011

(65) Prior Publication Data

US 2013/0075308 A1 Mar. 28, 2013

(30) Foreign Application Priority Data

May 31, 2010 (IT) ..... RE2010A0045

(51) Int. Cl.
*B03C 7/00* (2006.01)
*B03C 7/12* (2006.01)

(52) U.S. Cl.
CPC .. *B03C 7/12* (2013.01); *B03C 7/006* (2013.01)
USPC ..... 209/127.3; 209/12.2; 209/241; 209/247; 209/127.1; 209/127.2; 209/127.4; 209/128; 209/129; 209/130; 209/131

(58) Field of Classification Search
USPC ..... 209/12.2, 127.1–131, 241, 247
See application file for complete search history.

(56) References Cited

U.S. PATENT DOCUMENTS 5,289,922 A 3/1994 Inculet et al.
5,885,330 A * 3/1999 Lee ..... 95/69

(Continued)

FOREIGN PATENT DOCUMENTS

| | | | |
|---|---|---|---|
| DE | 3035649 | A1 | 4/1982 |
| WO | 9306934 | A1 | 4/1993 |
| WO | 0054885 | A1 | 9/2000 |
| WO | 0061292 | A1 | 10/2000 |

*Primary Examiner* — Prasad Gokhale
(74) *Attorney, Agent, or Firm* — Volpe and Koenig, P.C.

(57) ABSTRACT

A method for separating a granular synthetic material from a loose mass of various synthetic materials includes: conveying the granular mass along a trajectory having a rubbing surface subjecting the mass falling from the rubbing surface to an electrical field; and collecting at least one of the masses separated by the electrical field. The mass advances in a single layer on the rubbing surface, while maintaining the single layer contact with the rubbing surface, the rubbing surface being subjected to repeated acceleration in opposite directions in the plane of the rubbing surface, or tangential thereto to move the mass on the surface in order to improve the electrostatic charge. The rubbing surface is made of or clad with a material having intermediate triboelectric properties with respect to those of the granular mass, and is clad with a same material as that which it is intended to separate from the mass.

31 Claims, 10 Drawing Sheets

(56) References Cited

U.S. PATENT DOCUMENTS

| | | | | |
|---|---|---|---|---|
| 6,329,623 | B1 * | 12/2001 | Yan et al. | 209/129 |
| 6,365,857 | B1 * | 4/2002 | Maehata et al. | 209/127.3 |
| 6,447,645 | B1 * | 9/2002 | Barrett et al. | 162/233 |
| 6,452,126 | B1 * | 9/2002 | Xiao et al. | 209/127.1 |
| 6,681,938 | B1 | 1/2004 | Link et al. | |
| 7,931,734 | B2 * | 4/2011 | Moosmuller et al. | 95/31 |
| 2002/0189977 | A1 * | 12/2002 | Maehata et al. | 209/128 |
| 2003/0132140 | A1 * | 7/2003 | Oder et al. | 209/218 |
| 2007/0084758 | A1 * | 4/2007 | Endo et al. | 209/127.3 |
| 2008/0029441 | A1 * | 2/2008 | Deiseroth et al. | 209/130 |
| 2010/0078361 | A1 | 4/2010 | Bohm et al. | |

* cited by examiner

METHOD AND A DEVICE FOR SEPARATING PARTICLES OF A DETERMINED SYNTHETIC MATERIAL FROM PARTICLES OF DIFFERENT SYNTHETIC MATERIALS

TECHNICAL FIELD

The present invention relates to recuperation of articles made of synthetic material gathered in refuse collection where a principal aim is to use the materials for recycling.

BACKGROUND ART

In the prior art recycling is attained by first mincing the articles made of materials that are different from one another, with the aim of obtaining a granular material having an average size in the order of 0.5-25 mm.

The granular material comprises a mass made up of granules of various materials which in order to be re-utilised have to be separated such as to obtain homogeneous masses comprising granules of the same material.

Granule separation techniques are known for plastic materials which use the triboelectric effect, which is based on the following phenomenon.

By causing particles of a first material A to rub against particles of a second material B, particles A and B become electrostatically oppositely charged.

By the same process of rubbing, particles of a same type do not become charged at all.

The prior art describes various triboelectric separation methods of particles of different materials, which methods comprise:

a. undifferentiated collection of objects made of a plastic material;
b. cleaning of the objects;
c. mincing the objects in order to reduce them to particles of a homogeneous size;
d. an electrostatic charging operation;
e. transit of the electrically-charged particles in an electrical field.

U.S. Pat. No. 6,903,294 describes a separation device comprising a section for electrostatically charging by reciprocal rubbing of different types of synthetic material, a first electrostatic separation station located superiorly, at least a second electrostatic separation station located at a lower level, and a collection station for the separated particles, where the stations are provided with a rotary-drum metal electrode having a part on which the particles are made to fall, and an adjacent electrode charged oppositely in order to create an electrical field between the first and the second electrode, such that the particles falling on the first electrode and passing through the electrical field separate electrostatically according to their polarity and their charge.

U.S. Pat. No. 6,927,354 comprises a device for electrically charging particles of an electrically-insulating material comprising a metal cylinder internally of which the particles are made to transit between an inlet mouth and an outlet mouth. The cylinder is set in rotation about the axis thereof which is orientated such that the particles rub against one another and against the wall of the cylinder, thus taking on an electrostatic charge.

An electrostatic separation turret downstream of the cylinder separates the particles according to their charge.

U.S. Pat. No. 5,289,922 illustrates the electrostatic separation of a mixture of plastic materials by passing the granules of material in a rotary cylinder which can be made of metal or constituted by one of the materials to be separated, and precisely by the material that is present in the lowest quantity in the granular mass.

When the cylinder is constituted by the smallest material in the granular mass, it has the task of increasing the electrostatic charge of the granules of material present in the greatest quantity in the granular mass.

The electrostatic charging, in the prior art, is created by advancing the mass of the particles on a surface, so that when in contact with one another they are obliged in some way to rub against one another, losing or receiving electrons according to their nature.

The prior art suffers from a certain number of drawbacks, among which of not least importance is the fact that generally the reciprocal dragging between particles is not sufficient nor sufficiently homogeneous to give the particles an advantageous quantity of charge.

U.S. Pat. No. 6,681,938 discloses an improved or enhanced triboelectrostatic separator which provides for multiple means of egress for components from the separation of fly ash.

Sized particles make contact with a charging surface to impart positive, negative or no charges on the particles. Some of the particles, depending from their chemical composition, become positively charged, other particles become negatively charged and some particles are not charged at all.

The charged and uncharged particles are passed through an electrostatic separator consisting of a plurality of conducting electrodes or charged louvered plates, across which a high voltage is applied.

The known systems do not, in summary, enable control to be made of the charge density taken on by the various particles, but only the polarity of the charge.

As the force to which the particles are to be subjected when they cross the electrical field depends on the density of the load, which in turn depends on the mass of particles subjected to rubbing, sometimes it is not possible to separate the two different materials from one another which charge up with the same polarity and are present in such proportions as to absorb the same charge density.

DISCLOSURE OF INVENTION

The aim of the present invention is to make available a method and a device for performing triboelectrical separation of synthetic materials present in unknown proportion in a granular mass, obviating the above-cited drawbacks.

In the invention, the method for separating the granules of a specific material from a granular mass, deriving from the mincing of articles made of different synthetic materials originating from an undifferentiated refuse collection, generally comprises the following activities.

After washing the synthetic articles, mincing them and drying them, the mass M of granules is subjected to an electrostatic charging action by rubbing against a rubbing surface constituted by one of the materials present in the mass.

The force at which the granites are maintained into contact with the rubbing surface is higher than the gravity force.

The mass, charged in this way, is made to fall across an electrical field, resulting in a separation into three piles of granules, of which: a first pile of granules are not deviated by the electrical field, which pile is constituted by the same material as the rubbing surface; a second pile of negatively-charged granules, deviated towards the positive electrode of the electrical field, and a pile of positively-charged granules deviated towards the negative electrode of the electrical field.

The operation is repeated with the positively-charged materials, using a rubbing surface constituted by one of the materials, and collecting the pile of granules which is not deviated by the electrical field.

The above operations are repeated with the negatively-charged materials, using a rubbing surface constituted by one of the materials, and collecting the pile of granules which are not deviated by the electrical field.

The above-described operations are repeated with the residual piles of positively- or negatively-charged materials with, each time, a rubbing surface constituted by the material to be separated, up until the residual mass of materials is reduced to insignificant quantities for the purposes of separation.

If for example the initial granular mass M comprises seven materials identified in the triboelectric series with references from M1 (negative) to M7 (positive), the mass is treated on a rubbing surface constituted by the material M1, which is thus separated from materials M2 to M7.

By operating in succession in the same way, using a rubbing surface constituted by the M2 material, then the M2 material is separated from the materials from M3 to M7; using a rubbing surface constituted by material M3, then the M3 material is separated from materials from M4 to M7; using a rubbing surface constituted by material M4, then the M4 material is separated from materials from M5 to M7; using a rubbing surface constituted by the material M5, then the M5 material is separated from materials M6 and M7; finally, using a rubbing surface constituted by material M6, the M6 material separates from the M7 material.

A different separation scheme for the seven materials first comprises using material M4 for the rubbing surface, such as to obtain a pile constituted by materials M1, M2 and M3, a pile constituted by materials M5, M6 and M7, and a pile of material M4.

By using a rubbing surface made of material M2 for the pile constituted by materials M1, M2 and M3, it is possible to obtain three piles, each of which is composed of a single material; a similar result is obtained by using material M6 for the rubbing surface for the pile of materials comprising M5, M6 and M7.

For actuating the method, and in all of the above-reported examples, the air which invests the particles during the triboelectric charging stage must be conditioned at least in regard to moisture.

The moisture must be less than 30% if the charged particles are to be prevented from losing their charge to the air.

Further, by reducing the moisture it is possible to increase the level of the electrical field between the armatures without the electrical discharge taking place.

It has emerged from testing procedures that in the presence of a high degree of moisture the plastics de-charge over different times: if two different materials were to charge up similarly by rubbing against the charging surfaces, in some cases it would be possible to introduce a controlled-moisture station in order to de-charge the materials that are more sensitive to moisture such as to be able to separate the remaining materials in the following stage of crossing the armatures.

Up to now reference has been made to the material selected for the rubbing surface being the same material as the granules which are to be separated from the mass of granules.

It is however clear that, especially though not exclusively, when the mass of material comprises granules of two materials only, the material chosen for the rubbing surface can also be a material having intermediate triboelectric properties with respect to those of the two materials to be separated.

The device for actuating the above-described method comprises, according to the invention, means for arranging and advancing, on the rubbing surface, a mass of granules.

The device comprises also means for maintaining the granules against the rubbing surface with a force higher than the gravity force.

The mass of granules is thin as necessary for minimising the reciprocal rubbing of the granules; a single layer of granules is preferred.

Means are provided for subjecting the rubbing surface to repeated accelerations in opposite directions, having a component in the plane of the surface, with the aim of maximising the rubbing activity between the single granules and the surface.

An electrical field located downstream of the rubbing surface in the trajectory followed by the granules which leave the surface is provided.

The electrical field is for example generated by the difference in tension between two facing armatures.

The surfaces of the armatures, flat or conical, should preferably diverge in order to prevent the particles deviated by the electrical field established between the two armatures from bouncing on them.

As the electrical field reduces as the reciprocal distance between the armatures grows, in order to maximise the level of the electrical field and with it the deviating force acting on the particles, a preferable solution is to arrange pairs of armatures in series on the trajectory of the particles, which armatures face one another and are characterised by progressively growing differences of potential.

BRIEF DESCRIPTION OF DRAWINGS

The advantages and characteristics of the invention will emerge from the detailed description that follows, which illustrates various embodiments of the invention, given by way of non-limiting example, with the aid of the accompanying figures of the drawings.

BEST MODE FOR CARRYING OUT THE INVENTION

Figure 1:
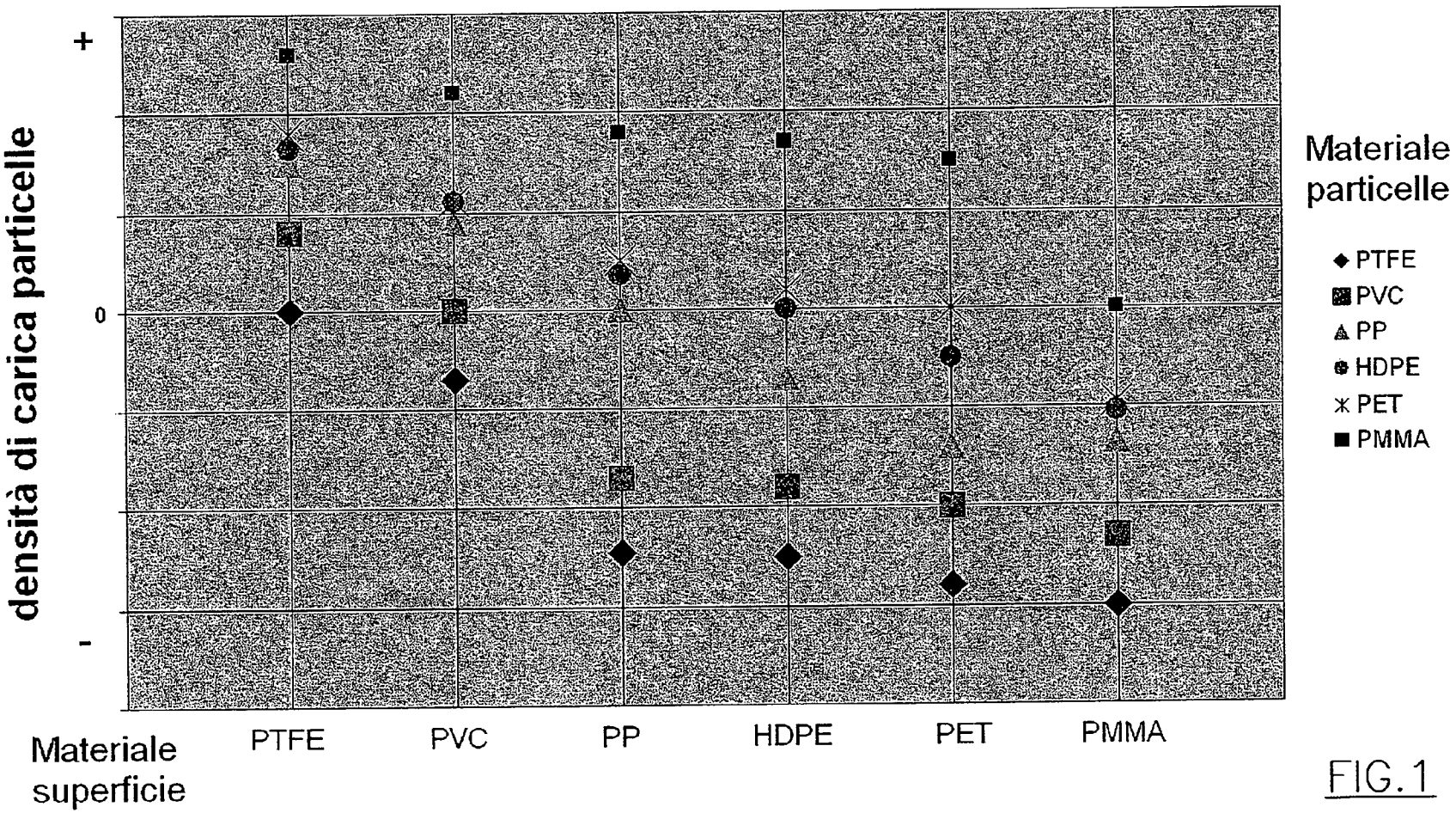
FIG. 1 schematically illustrates the charge density and polarity of various materials according to the nature of the rubbing surface.

FIG. 1 lists the order of densities of charge and the polarity assumed by particles of various materials by rubbing against surfaces made of different materials.

In the figure, the various materials are denoted by the following letters:

a. PTFE (polytetrafluoro ethylene)
b. PVC (polyvinyl chloride)
c. PP (polypropylene)
d. HDPE (high-density polyethylene)
e. PET (polyethylene terephthalate)
f. PMMA (polymethyl methacrylate).

The diagram shows that a particle of a certain material, when rubbing against a rubbing surface of the same material, tends to charge up very little or not at all.

The other particles, when rubbing against the same rubbing surface, charge positively or negatively according to their triboelectric series.

Taking as an example a rubbing surface made of HDPE, the particles of PET and PMMA charge positively with a charge density that is considerably higher for PMMA.

By rubbing against an HDPE surface, on the other hand, the particles of PP, PVC and PTFE charge negatively, with progressively greater charge densities.

Figure 2:
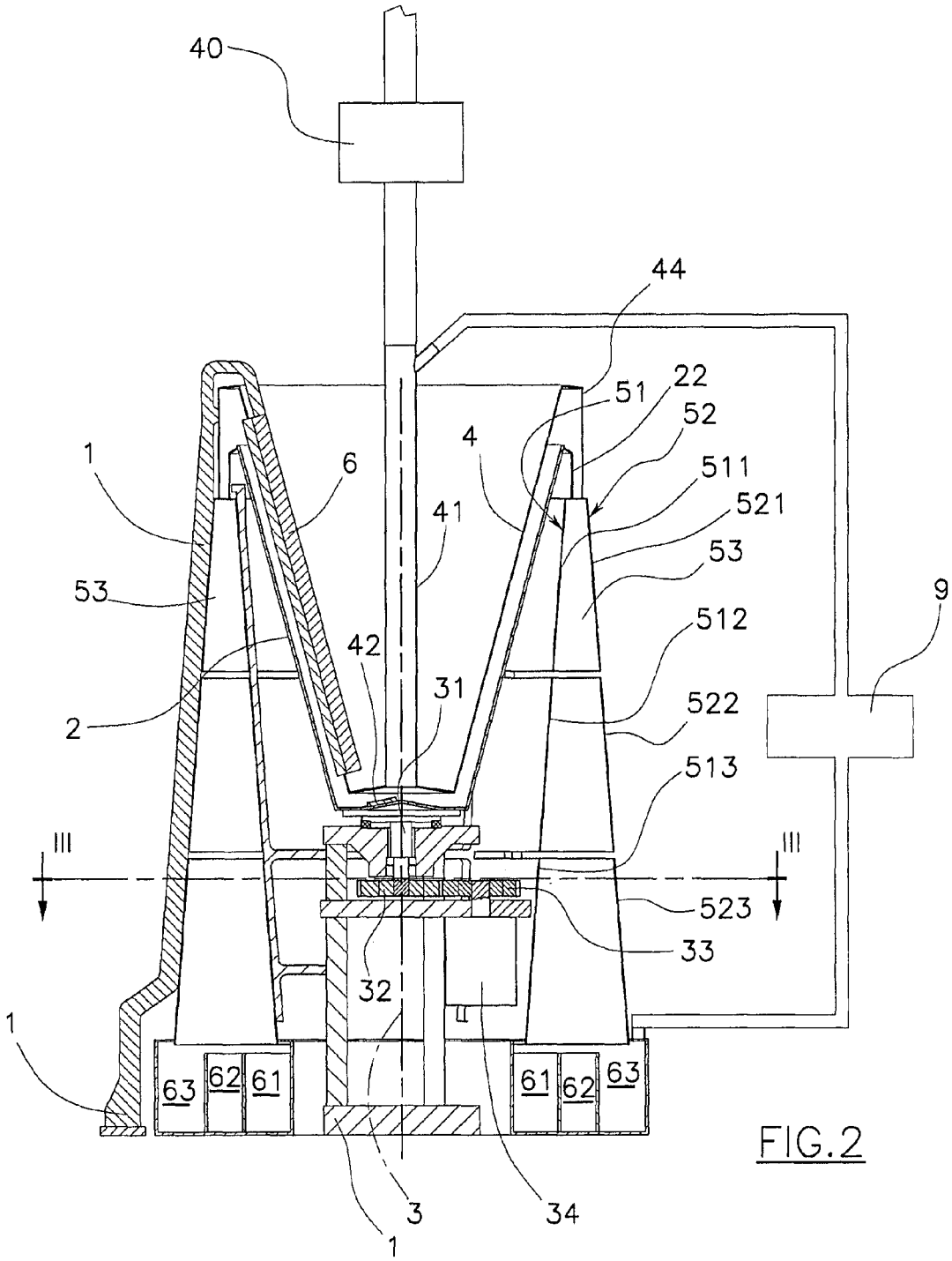
FIG. 2 schematically illustrates a first embodiment of the invention.
Figure 3:
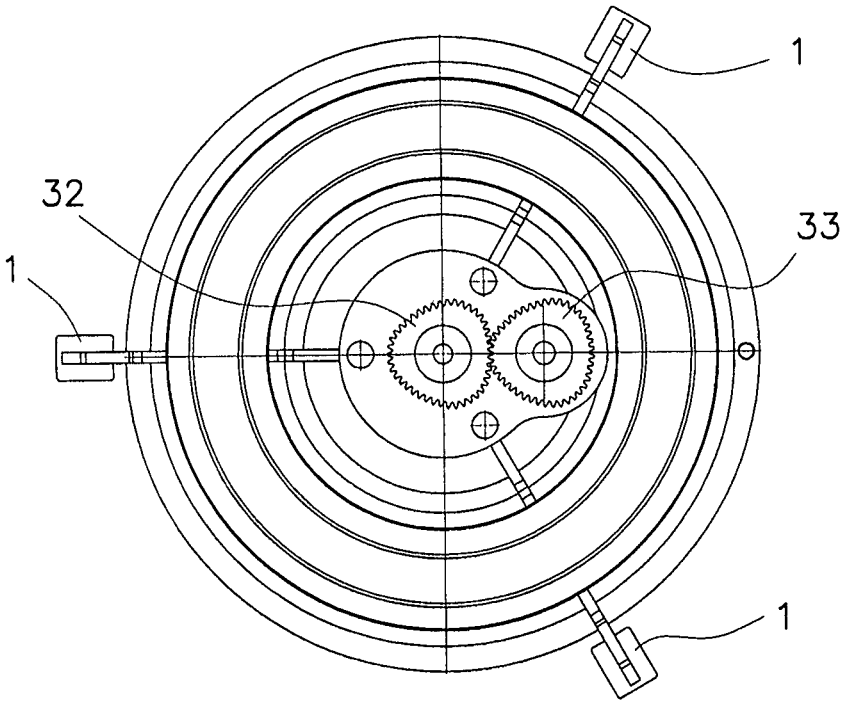
FIG. 3 is section III-III of FIG. 2.

FIGS. 2 and 3 illustrate a first mode of actuation of the invention.

The figures show a basement 1 which supports a truncoconical recipient 2 rotating on the axis 3.

The recipient 2 is coated with a layer of the same material constituting the granules which are to be separated from the mass of granules.

In particular, the base of the recipient 2 is supported by an axial pin 31 keyed on the axis of a non-circular cog wheel 32 enmeshing with a like wheel 33 having an anti-symmetrical profile, set in rotation with a uniform circular motion by an electric motor 34 borne by the basement.

In this way the wheel 32 is provided with non-uniform circular motion, characterised at each revolution by at least an acceleration and a corresponding deceleration.

The basement 1 supports a fixed cover 4, parallel and equidistanced from the recipient 2.

The cover 4 is provided with an axial and vertical central conduit 41, through which the material in the form of particles to be separated is introduced.

A batcher or regulator 40 of the flow of particles is inserted along the central conduit 41.

A conveyor shovel 42 is present at the base of the conduit 41, which shovel 42 pushes the falling material on the periphery into the centre of the recipient 2.

The basement 1 comprises two concentric truncoconical surfaces 51 and 52 which define a space 53 that broadens in a downwards direction, and which overlies three concentric collection chambers 61, 62 and 63.

The truncoconical surfaces 51 and 52 each comprise, in an axial direction, three sections 511, 512 and 513, and respectively 521, 522 and 523 made of conductive material, reciprocally insulated, and set in electrical tension by means which are not illustrated.

The differences in electrical tension are in progression between the pairs of armatures 511/521, 512/522 and 513/523 in order to maximise the electrical field between the armatures along the trajectory of the material.

Walls 22 and 44 are comprised between the upper edge of the recipient 2 and the upper edge of the cover 4, which walls convey the material in the space 53.

A neutralising device 6 of the surface charge runs along a generatrix of the cover 4.

The flow of material is facilitated by an air current which is conveyed by conditioning means 9 from the material collection chambers 61, 62 and 63 to the central tube 41 for inlet of the material.

The task of the conditioning means is to control at least the humidity in the air, maintaining it at below 30%.

Figure 4:
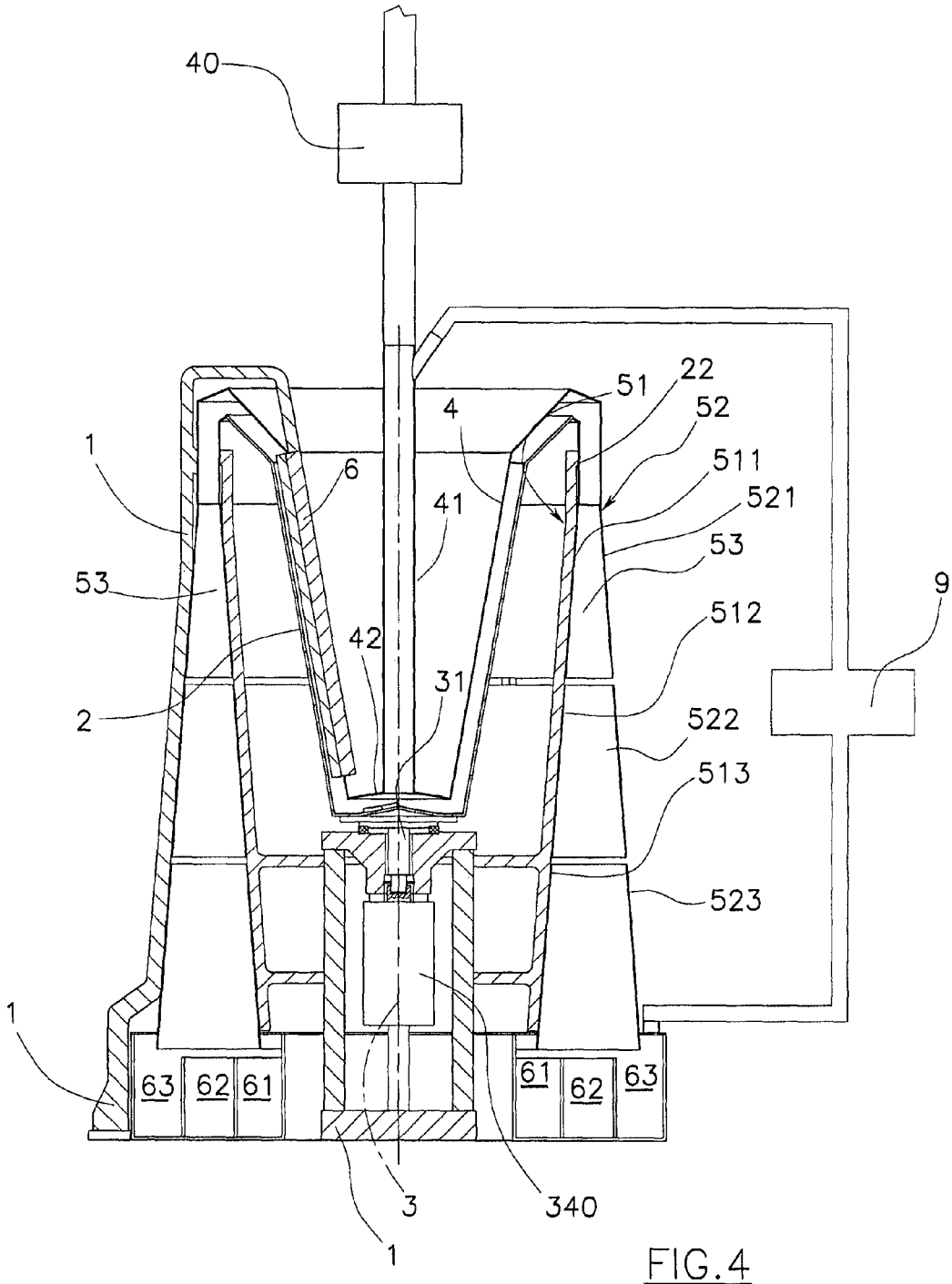
FIG. 4 schematically illustrates a second embodiment of the invention.

FIG. 4 shows a second embodiment of the invention, in which the parts corresponding to the first embodiment illustrated in FIGS. 2 and 3 are denoted using the same numerical references.

The only difference between the first and the second embodiment consists in the fact that in the second embodiment (FIG. 4) the pin 31 supporting the recipient 2 is directly keyed on the rotor in the electrical motor 340, which comprises mechanical or electrical means for transmitting the motion.

Figures from 5 to 7 illustrated a third embodiment of the invention.

The figures show a hopper 100 provided with an outlet mouth 102 having shutter means 121.

The shutter means 121 let a disordered flow of granules fall into a structure 210 which directs the flow internally of a cylindrical/conical tube 300, which is free to rotate and is supported by suitable bearings 301.

The tube 300 exhibits an inclined axis in the vertical plane such as to facilitate advancement of the granules by force of gravity.

The tube 300 is connected to mechanical means 400 destined to set it in rotation about the axis thereof at a variable velocity over a single revolution.

In the example, the means 400 comprise a casing in which two reciprocally-enmeshed cog wheels 402, 403 are free to rotate.

The wheels 402 and 403 each exhibit an anti-symmetrical profile with respect to the profile of the other wheel with respect to the respective rotation axes, such that while rotating in opposite directions they remain enmeshed, rotating with a variable transmission ratio during each revolution.

One of the two wheels, and precisely the wheel 402, is connected to an electric motor 421 keyed on the rotation axis thereof, which impresses thereon a uniform circular motion at a velocity comprised between 100 rad/sec and 500 rad/sec, preferably 300 rad/sec.

The other wheel 403, enmeshing with the first, is moved in a circular motion having the same mean angular velocity as the wheel 402, but variable during each revolution, and is subject at each revolution to at least a sharp to acceleration followed by a corresponding deceleration.

The tube 300 is fixed to the wheel 403 in a coaxial position to the rotation axis; the tube is therefore subject to a non-uniform circular motion. The particles rotate in the tube at a uniform velocity which is the same as the mean velocity of the tube: centrifugal force will determine the force of crushing of the particles against the wall, increasing the efficiency of the triboelectric charging and ensuring that the particles distribute uniformly on the internal surface of the tube. The angular acceleration and deceleration of the tube is such as to determined relative dragging between the tube wall and the particles. Apart from facilitating the advancement of the particles, the conical shape of the tube guarantees maintenance of a thin layer of particles in all the stages of crossing the tube.

At least an electrode can be rested on the inside of the tube 300, which electrode is earthed and made of graphite and is protected on the contact surfaces with the granules.

An underlying electrical structure is located downstream of the cylinder 300, comprising two concentric electrodes, respectively positive 410 and negative 420, between which a potential difference is maintained such as to determine a maximum electrical field between them comprised between 100 kV/m and 1000 kV/m, preferably 400 kV/m.

With the aim of maximising the electrical field, each electrode and respectively the electrode facing it can be constituted by at least two electrodes in succession, the potential differences between the pairs of facing electrodes progressively growing in the advancement direction of the material.

Thus an electrical field between the electrodes is created in which the mass of granules, electrically charged due to rubbing against the internal surface of the tube 300, transits by free fall.

During the course of the fall the negatively-charged granules are deviated towards the positive electrode, while the positively-charged granules are deviated towards the negative electrode, and the granules bearing no charge or nearly so are not substantially deviated and follow a vertical trajectory.

Thus three piles are formed 500, 501 and 502, which collect the granules carrying the above-specified charges.

The tube 300 is of a length comprised between 800 and 1500 mm, in the illustrated example 1000 mm, and an internal diameter comprised between 150 and 400 mm, in the example 300 mm.

The mean angular velocity of the tube 300 is comprised between 100 and 500 rad/sec, and preferably is 300 rad/sec.

The whole process takes place in a conditioned environment by means 209 for maintaining at least a level of humidity that is less than 30%.

Figure 8:
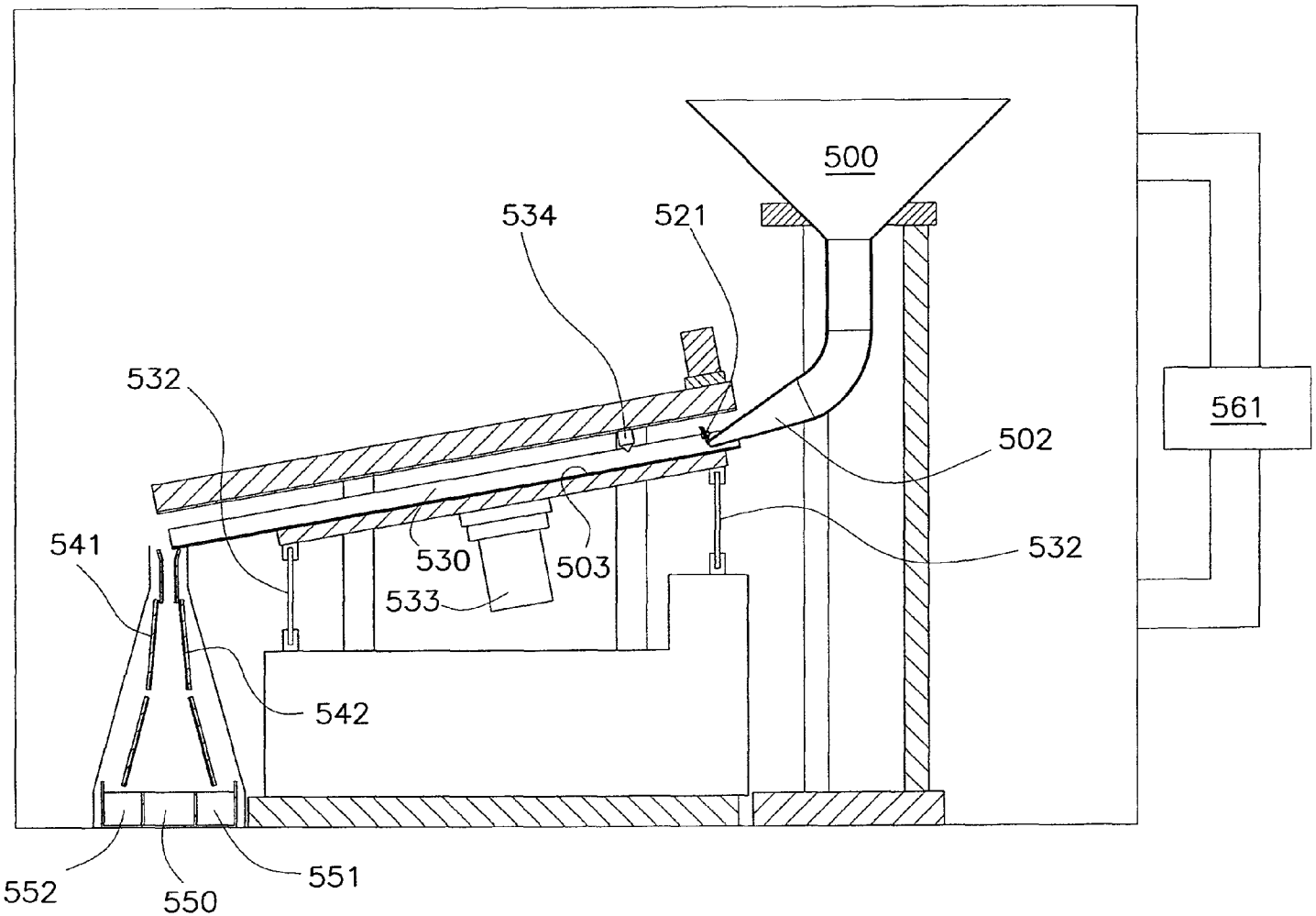
FIG. 8 schematically illustrates a fourth embodiment of the invention.

The fourth embodiment of the invention is illustrated in FIG. 8 and comprises a hopper 500 in which the mass containing granules of different materials is placed, in indefinite proportions, previously washed and dried.

The hopper 500 comprises a thin outlet mouth 502 shaped such as to enable the fall by force of gravity of a line of granules having a height of a little greater than the maximum dimension of the granules contained in the hopper.

The mouth 502 is provided with shutter means and closure means 521 of known type and not described in detail.

The granules falling from the mouth 502 are received by a surface 503, shaped as a chute 530 having a flat base 503.

The chute 530 is inclined such as to facilitate the advancement of the granules by gravity.

It is supported such as to be able to oscillate in the plane of the flat base 503, in a direction which coincides with the axis of the chute such that the granules tend to be arranged on the flat base in a single layer, the rubbing between the adjacent granules being so reduced and the rubbing of the single granules with the base of the chute being so increased.

In the illustrated example the chute is supported by leaf springs 532 and is connected to means 533 for impressing a vibration thereon, which leads to sharp accelerations in opposite directions.

At least an electrode 534 can be rested on the chute 530, which electrode 534 neutralises the charge in graphite and is earthed.

The electrode is provided with reciprocating movements along the chute 530.

The vibration has the aim of increasing the rubbing of the overlying granules on the base of the chute, increasing the charge density of the granules themselves.

The means 533 are for example constituted by a rotary-mass vibrator, destined to impress vibrations on the chute 530 of 0.1-5 mm and a period of from 0.01-1 second.

In the example the axial length of the chute 530 is 3000 mm, and can advantageously be comprised between 1000 and 10000 mm.

The breadth of the base of the chute 530 is 1000 mm, and can advantageously be comprised between 500 and 2000 mm.

The inclination of the base of, the chute 530 is adjustable with respect to the horizontal.

The shutter means 531 of the mouth 502 are adjustable such as to enable the fall of a quantity of granules comprised between 100 and 1000 kg/h.

The downstream end of the chute 530 is positioned such as to overlie an electrical structure comprising two polarised electrodes, respectively positive 541 and negative 542, between which a potential difference is maintained which is such as to determine a maximum electrical field between them which is comprised between 100 kV/m and 1000 kV/m, and is preferably 400 kV/m.

Thus an electrical field is created between the electrodes, in which the mass of granules electrically charged by rubbing against the base 503 of the chute 530 transits by force of gravity.

During the course of the fall the negatively-charged granules are deviated towards the positive electrode 541, the positively-charged granules are deviated towards the negative electrodes 542, and the granules bearing little or no charge are not substantially deviated and follow a vertical trajectory. Three piles 550, 551 and 552 are thus created, which collect the granules charged as specified above.

In this case too the environment in which the process takes place is conditioned thanks to the device 561.

The plant described in the example has a treatment capacity of 100÷1000 kg/h.

Figure 9:
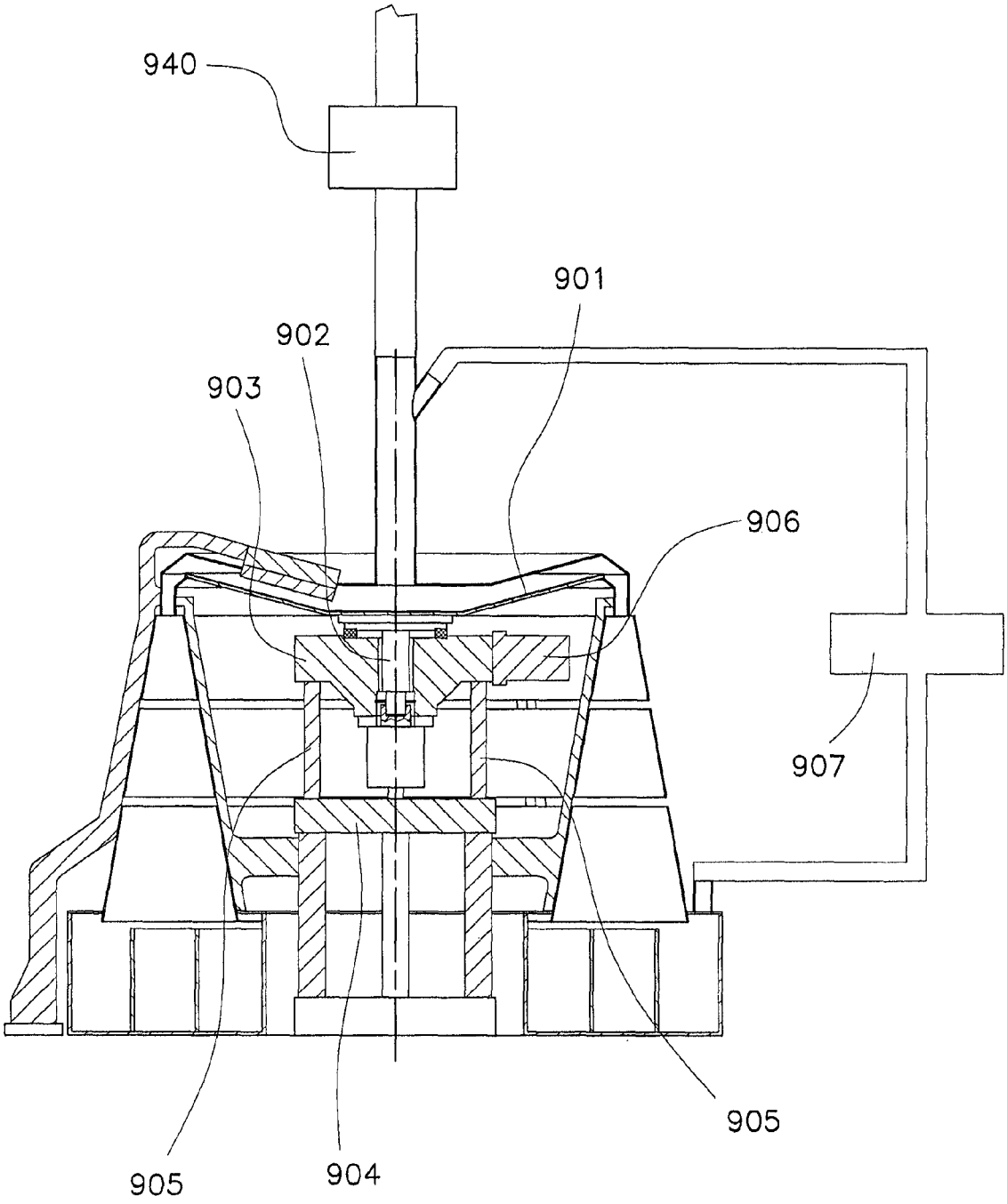
FIG. 9 illustrates a fifth embodiment of the invention.

In the embodiment illustrated in FIG. 9, the rubbing surface 901 has a very flared conical shape, similar to a concave disc.

It is supported by a shaft 902 located at the centre.

The shaft 902 is free to rotated in relation to a body 903 connected to a base 904 by elastic means such as elastomer springs 905.

Two rotating-mass devices 906 are fixed to the body 903, which devices 906 are destined to impress the required accelerations on the rubbing surface 901.

In this case too conditioning means 907 are provided, as well as an adjusting device 940 of the particle flow.

Figure 10:
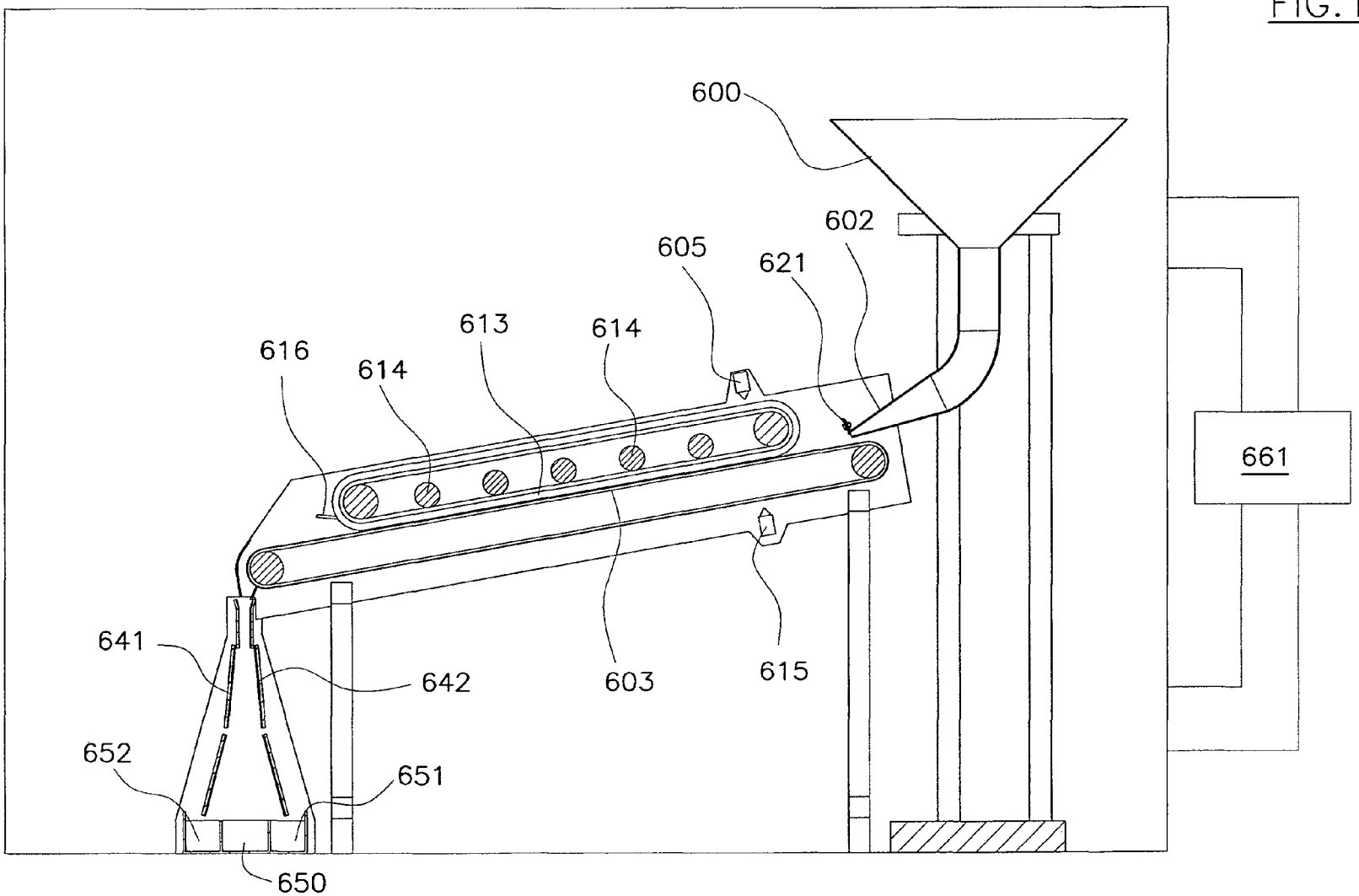
FIG. 10 illustrates a sixth embodiment of the invention.

With reference to FIG. 10, the sixth embodiment of the invention comprises a hopper 600 in which the mass containing granules of various materials is placed, in indefinite proportions, previously washed and dried.

The hopper 600 comprises a thin outlet mouth 602 shaped such as to enable the fall by force of gravity of a line of granules having a height of a little greater than the maximum dimension of the granules contained in the hopper.

The mouth 602 is provided with shutter means and closure means 621 of known type and not described in detail.

The granules falling from the mouth 602 are received by a surface constituted by a conveyor belt 603, clad with a synthetic material.

A further belt 613 overlies the conveyor belt 603, which further belt 613 is clad with a spongy elastomer material, kept pressed against the conveyor belt 603 by suitable thrust rollers 614.

The belt 613 is moved at a different velocity to the conveyor belt 603.

Means 616 are provided for detaching the particles which might stay attached to the belt 613, as well as devices 615 and 605 for neutralising the charge.

The downstream end of the belt 603 is positioned such as to overlie an electric structure comprising two electrodes, respectively positively 641 and negatively 642 charged, between which a potential difference is maintained such as to determine a maximum electrical field between them which is comprised between 100 kV/m and 1000 kV/m, preferably 400·kV/m.

An electrical field is thus created between the electrodes, in which the mass of granules electrically is charged by the action of rubbing against the belt 603.

During the course of the fall the negatively-charged granules are deviated towards the positive electrode 641, the positively-charged granules are deviated towards the negative electrodes 642, and the granules bearing little or no charge are not substantially deviated and follow a vertical trajectory.

Three piles 650, 651 and 652 are thus created, which collect the granules charged as specified above.

In this case too the environment in which the process takes place is conditioned thanks to the device 661.

Further teachings can be derived from the following examples.

EXAMPLE 1

Relating to the Device of FIG. 8

A granular mass is placed in the hopper 500, comprising granules in unknown proportions, singly constituted by one of the following materials: PMMA, PTFE, PET, PVC.

With the mass of PVC granules to be separated, the rubbing surface constituted by the base 503 of the chute is realised or clad with PVC.

The PVC granules do not therefore acquire any electrical charge by rubbing against the chute.

Three piles are obtained downstream of the electrical field, respectively a central pile 550 into which only the PVC granules fall, a pile 55 underlying the negative pole, into which the PMMA and PET granules fall, and a pile 552 underlying the positive pole into which the PTFE granules fall.

EXAMPLE 2

Figure 5:
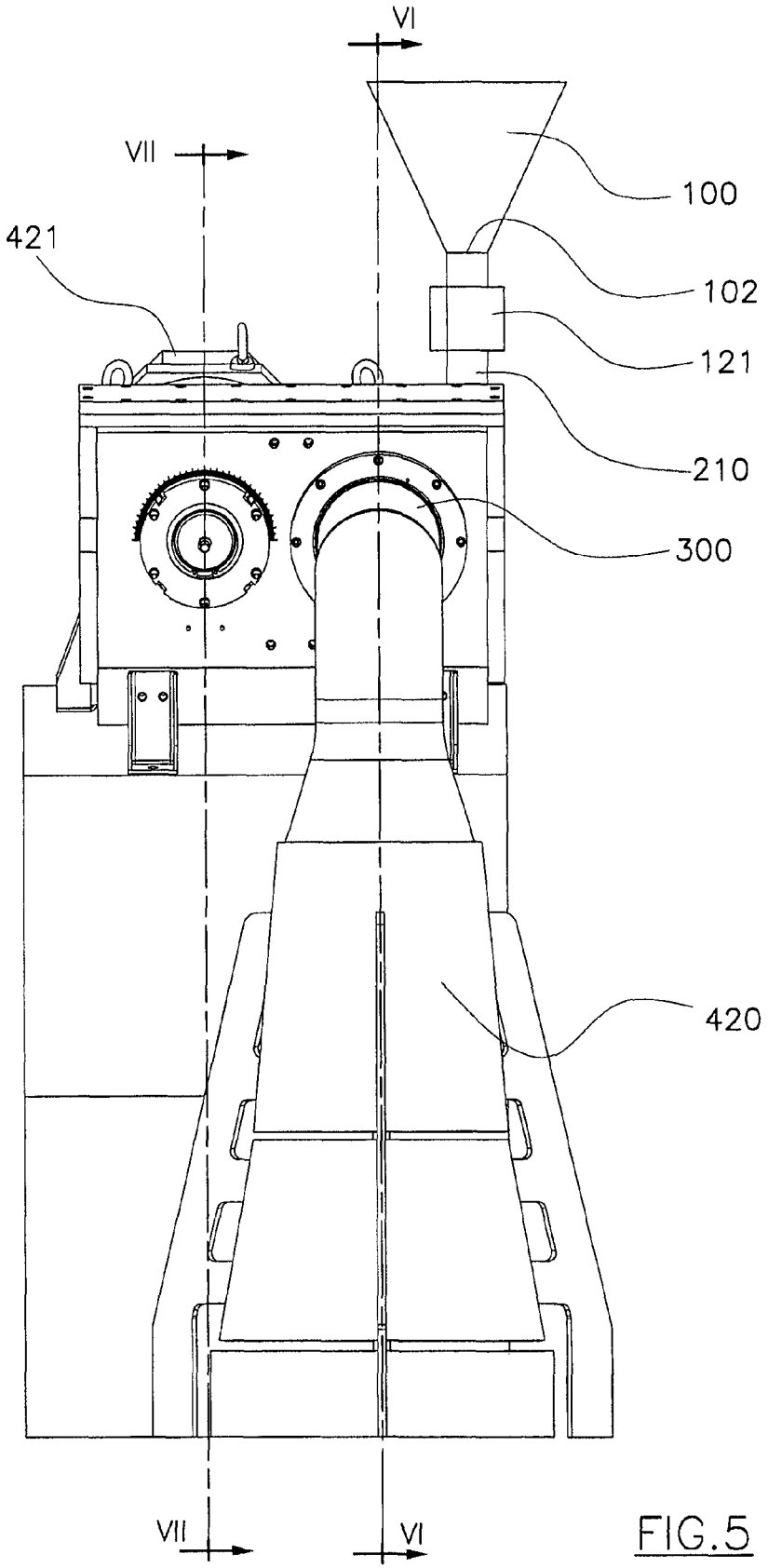
FIG. 5 is a schematic illustration of a third embodiment of the invention.
Figure 6:
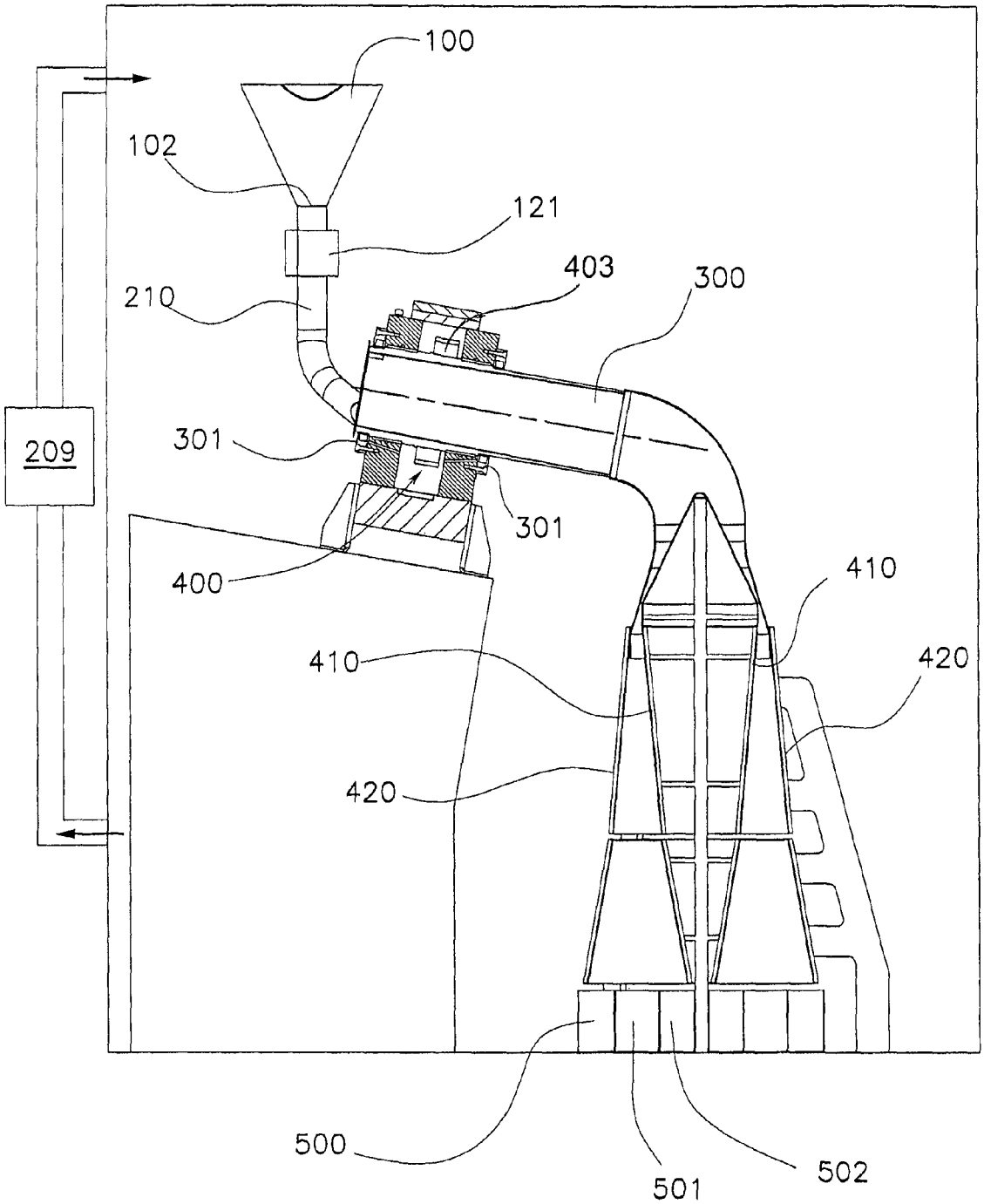
FIG. 6 is section VI-VI of FIG. 5.
Figure 7:
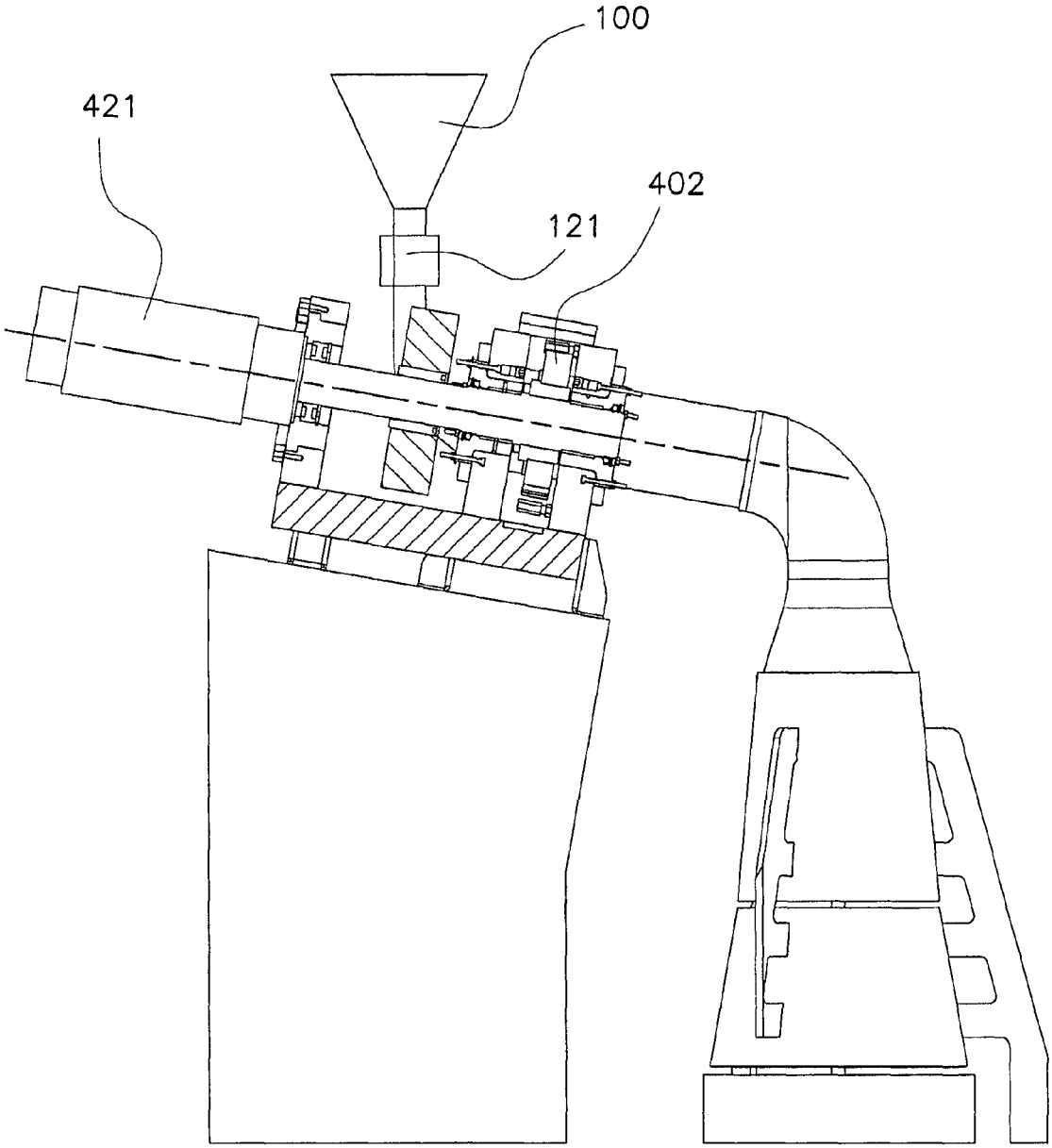
FIG. 7 is section VII-VII of FIG. 5.

Relating to the Device of FIGS. 5 to 7

The mass of granules in the hopper 100 comprises respectively PVC, PP and PTFE granules.

With the mass of PVC granules to be separated, the internal surface of the tube 300 is clad with PVC and a pile 501 of granules not deviated by the electrical field is obtained, constituted entirely of PVC.

The invention is not limited to the described examples, and any variants and improvements can be brought thereto without its forsaking the ambit of the claims that follow.

The invention claimed is:

1. A method for separating a synthetic material in granular form from a loose mass of various synthetic materials, the method comprising:

conveying a measured quantity of a granular mass along a trajectory comprising a rubbing surface, subjecting the measured quantity of the mass falling down from the rubbing surface to an electrical field, collecting at least one of the masses of granules separated by the electrical field wherein the measured quantity of the mass is made to advance in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, wherein the rubbing surface is clad with or made of a same material as a material which it is intended to separate from the mass.

2. An apparatus for separating a synthetic material in granular form from a loose mass of various synthetic materials, the method comprising:

conveying a measured quantity of a granular mass along a trajectory comprising a rubbing surface, subjecting the measured quantity of the mass falling down from the rubbing surface to an electrical field, collecting at least one of the masses of granules separated by the electrical field wherein the measured quantity of the mass is made to advance in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, the apparatus comprising a conveyor provided with a flow regulator to convey a measured quantity of the granular mass along a trajectory comprising a rubbing surface subjected to repeated acceleration in opposite directions contained in the plane of the rubbing surface, or tangential thereto and on which the mass advances in a single layer by rubbing on the surface, and an electrical field generator, located downstream of the rubbing surface, the mass of granules is made to pass across the electrical field, and a device that collects at least the granules which are not deviated by the electrical field, wherein the rubbing surface is clad with or made of a same material as a material which it is intended to separate from the mass.

3. A method for separating a synthetic material in granular form from a loose mass of various synthetic materials, the method comprising:

conveying the granular mass along a trajectory comprising a rubbing surface, subjecting the mass falling down from the rubbing surface to an electrical field, collecting at least one of the masses of granules separated by the electrical field wherein the mass is made to advances in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, and is clad with, or made of, a same material as a material which it is intended to separate from the mass.

4. The method of claim 3, wherein the granular mass is kept pressed against the rubbing surface with a force higher than the gravity.

5. The method of claim 4, wherein the granules are kept pressed against the rubbing surface by centrifugal force.

6. The method of claim 3, wherein the granular mass is distributed on the rubbing surface in a single layer.

7. The method of claim 3, wherein the method is carried out in an environment having controlled temperature and humidity, the humidity being not above 30%.

8. The method of claim 3, further comprising an action configured to annul an electrostatic charge of the single granules before subjecting the granular mass of synthetic materials to the electrostatic charging action.

9. The method of claim 3, wherein the rubbing surface can be electrically neutralized.

10. The method of claim 3, wherein the masses of granules which are deviated by the electric field are subjected to a further electrical charging by rubbing on a rubbing surface constituted by a material chosen between the materials present in the granular mass, and successively are subjected to the action of an electric field such as to separate the mass of granules of the same material as the rubbing surface.

11. The method of claim 10, wherein the method is repeated a number of times which is not greater than the number of materials present in the granular mass minus one.

12. An apparatus for separating a synthetic material in granular form from a loose mass of various synthetic materials, the method comprising:

conveying the granular mass along a trajectory comprising a rubbing surface, subjecting the mass falling down from the rubbing surface to an electrical field, collecting at least one of the masses of granules separated by the electrical field wherein the mass is made to advance in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, and is clad with or made of a same material as a material which it is intended to separate from the mass, the apparatus comprising: a conveyor to convey a granular mass along a trajectory comprising a rubbing surface on which the mass advances in a single layer by rubbing on the surface, and an electrical field generator, located downstream of the rubbing surface, the mass of granules is made to pass across the electrical field, and a device that collects at least the granules which are not deviated by the electrical field.

13. The apparatus of claim 12, wherein the conveyor is shaped as a chute having a flat base constrained to move only within a plane of the base.

14. The apparatus of claim 12, wherein the conveyor is shaped as a rotating tube.

15. The apparatus of claim 14, further comprising an accelerator which imparts accelerations in opposite directions on the conveyor, wherein the accelerator comprises a mechanical transmission configured to set the tube in rotation with a uniform mean angular velocity and with an instantaneous angular velocity which varies cyclically in each single revolution.

16. The apparatus of claim 15, wherein the mechanical transmission comprises two non-circular cog wheels which are reciprocally enmeshed, which have an eccentric rotation axis and an asymmetrical profile with respect to the rotation axis.

17. The apparatus of claim 12, wherein the conveyor is shaped as a belt conveyor with a pressure conveyor overlying the belt conveyor, the pressure conveyor having a soft surface moved at a different velocity than the belt conveyor.

18. The apparatus of claim 12, wherein the conveyor is constituted or clad with a material having triboelectric properties which are intermediate in relation to triboelectric properties of the materials to be separated, being made of a same material as the granules which are to be separated from the mass of granules.

19. The apparatus of claim 12, wherein the conveyor exhibits a dragging surface for the granules of the granular mass.

20. The apparatus of claim 12, further comprising an accelerator which imparts accelerations in opposite directions on the conveyor.

21. The apparatus of claim 20, wherein the accelerations are contained within the rubbing surface or are tangential thereto.

22. The apparatus of claim 20, wherein the accelerator is a rotating-mass vibrator.

23. The apparatus of claim 12, wherein the electrical field generator is located downstream of the rubbing surface and comprises at least one pair of facing surfaces constituting two opposite electrodes set at different tensions.

24. The apparatus of claim 23, wherein the surfaces of each pair diverge in an advancement direction of the material.

25. The apparatus of claim 24, further comprising at least two pairs of facing surfaces, the differences in potential between the electrodes of each pair increasing in an advancement direction of the material.

26. The apparatus of claim 24, wherein an entity of the electrical field between the two surfaces of each pair is comprised between 100 and 1000 kV/m.

27. The apparatus of claim 12, wherein the rubbing surface is clad with or made of a same material as a material which it is intended to separate from the mass.

28. A method for separating a synthetic material in granular form from a loose mass of various synthetic materials, the method comprising:

conveying the granular mass along a trajectory comprising a rubbing surface, subjecting the mass falling down from the rubbing surface to an electrical field, collecting at least one of the masses of granules separated by the electrical field wherein the mass is made to advance in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, wherein the granular mass is kept pressed against the rubbing surface with a force higher than the gravity.

29. The method of claim 28, wherein the rubbing surface is clad with or made of a same material as a material which it is intended to separate from the mass.

30. An apparatus for separating a synthetic material in granular form from a loose mass of various synthetic materials, the method comprising:

conveying the granular mass along a trajectory comprising a rubbing surface, subjecting the mass falling down from the rubbing surface to an electrical field, collecting at least one of the masses of granules separated by the electrical field wherein the mass is made to advance in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, the apparatus comprising a conveyor to convey a granular mass along a trajectory comprising a rubbing surface on which the mass advances in a single layer by rubbing on the surface, and an electrical field generator, located downstream of the rubbing surface, the mass of granules is made to pass across the electrical field, and a device that collects at least the granules which are not deviated by the electrical field, and wherein the conveyor is shaped as a rotating tube.

31. An apparatus for separating a synthetic material in granular form from a loose mass of various synthetic materials, the method comprising:

conveying the granular mass along a trajectory comprising a rubbing surface, subjecting the mass falling down from the rubbing surface to an electrical field, collecting at least one of the masses of granules separated by the electrical field wherein the mass is made to advance in a single layer on the rubbing surface, while maintaining the single layer into contact with the rubbing surface the rubbing surface being subjected to repeated acceleration in opposite directions contained in the plane of the rubbing surface, or tangential thereto to move the mass on the surface in order to improve the electrostatic charge, the rubbing surface being clad with, or made of, a material having triboelectric properties which are intermediate with respect to triboelectric properties of the granular mass, the apparatus comprising a conveyor to convey a granular mass along a trajectory comprising a rubbing surface on which the mass advances in a single layer by rubbing on the surface, and an electrical field generator, located downstream of the rubbing surface, the mass of granules is made to pass across the electrical field, and a device that collects at least the granules which are not deviated by the electrical field, and wherein the conveyor is shaped as a belt conveyor with a pressure conveyor overlying the belt conveyor, the pressure conveyor having a soft surface moved at a different velocity than the belt conveyor.

* * * * *